United States Patent [19]

Johnson et al.

[11] Patent Number: 4,615,387

[45] Date of Patent: Oct. 7, 1986

[54] ANNULAR GAS TRAP

[75] Inventors: Dale V. Johnson, Metairie; John M. Bednar, Harvey, both of La.

[73] Assignee: Exxon Production Research Co., Houston, Tex.

[21] Appl. No.: 715,854

[22] Filed: Mar. 25, 1985

[51] Int. Cl.[4] ..... E21B 41/02

[52] U.S. Cl. ..... 166/242; 166/105.5; 166/244.1

[58] Field of Search ..... 166/247, 188, 244.1, 166/236, 279, 310, 265, 105.5

[56] References Cited

U.S. PATENT DOCUMENTS 3,379,259 4/1968 Metler ..... 166/242

FOREIGN PATENT DOCUMENTS 188424 8/1965 U.S.S.R. ..... 166/265

*Primary Examiner*—Stephen J. Novosad

*Assistant Examiner*—William P. Neuder

*Attorney, Agent, or Firm*—John S. Schneider

[57] ABSTRACT

Well apparatus for use in injecting corrosion inhibitor into the annulus between casing and tubing strings below an injection/packer assembly positioned in such annulus which includes an annular gas trap positioned below the injection/packer assembly. The annular gas trap comprises a plurality of individual gas traps. Each individual gas trap comprises a series of S-shaped conduits and includes one passageway open to the annulus above the gas trap and another passageway open to the annulus below the gas trap and a third passageway connecting those two passageways. A check valve may be positioned in each individual gas trap to prevent flow of fluids upwardly through the gas trap into the annulus above the gas trap and a seal may be provided on the gas trap to engage a polished bore receptacle formed on the casing string to seal off the space between the casing string and the annular gas trap.

7 Claims, 5 Drawing Figures

ANNULAR GAS TRAP

BACKGROUND OF THE INVENTION

1. Field of the Invention

The present invention concerns downhole apparatus for use during production of hydrocarbons from an oil or gas well in which means are provided to insure proper distribution of corrosion inhibitor and the like within the well casing to an area below a well packer and for subsequent circulation of the inhibitor with the produced hydrocarbons through well tubing extending through the packer to the earth's surface.

2. Description of the Prior Art

An oil or gas well equipped with a packer substantially off bottom as seen, for example, in U.S. Pat. No. 4,031,955 entitled "Down-hole Inhibitor Injector" by Charles A. Ledet, will have completion fluid in the annulus above the packer and formation gas in the annulus below the packer. If non-corrosive, this gas presents no problems. If, however, the gas contains some corrodents such as $H_2S$, $CO_2$, or water, the presence of the gas under the packer could cause severe problems. Unless equipped with very costly tubulars the corrosive gas can destroy the tubing and casing below the packer.

The Ledet patent discloses an assembly in which liquid corrosion inhibitor is flowed down through and into the annulus with the inhibitor solution passing through the packer. The packer assembly contains a valving apparatus and a circulation bypass for injection below the lower end of the packer assembly. Thus, to combat corrosion, corrosion inhibitor, as in the Ledet patent, can be jumped down the upper annulus and, using an injection assembly in conjunction with a packer, injected into the annulus below the packer. However, if gas is present in the lower annulus, the injected inhibitor will run down the pipe (tubing and/or casing) in rivulets. Such action will render the corrosion inhibition attempt useless, since to be effective the inhibitor must contact all of the pipe wall area. To be effective a device is needed that will maintain a column of inhibitor below the packer but will permit the inhibitor to be pumped through or passed through the device so that the inhibitor can go to bottom and into the tubing with the gas being produced.

In many wells, casing and tubing sizes will not permit the injection/packer assembly to be placed at bottom. Further, in deep wells, even if the injection/packer assembly could fit inside the casing, the wireline maintenance on the injection valve might not be possible because of the extreme difficulty in performing the deep wireline operations. To be of use in deep sour wells, the device must be virtually maintenance free, have as few moving parts as possible, be sturdy enough to withstand being run to 20,000 feet plus and permit the passage of the inhibitor while preventing the flip-flop of the inhibitor with the produced gas.

None of the prior art discloses an annular gas trap which effectively blocks the produced fluids from the pipe walls protected by the corrosion inhibitor.

SUMMARY OF THE INVENTION

In accordance with the present invention, an annular gas trap may be configured as a special section of the tubing string that is enlarged to accomodate a series of S-shaped conduits each of which forms an individual gas trap. Each S-shaped conduit is comprised of three vertical passage-ways, one open only to the upper tubing-casing annulus above the gas trap, another open only to the lower tubing-casing annulus below the gas trap, and the third open to and joining each of the other two. Optionally, a check value may be placed in the conduits of each gas trap to prevent gas from entering the lower annulus. The casing may provide a polished bore receptacle to engage a seal positioned on the outside of the enlarged tubing section.

DESCRIPTION OF THE PREFERRED EMBODIMENTS

Figure 1:
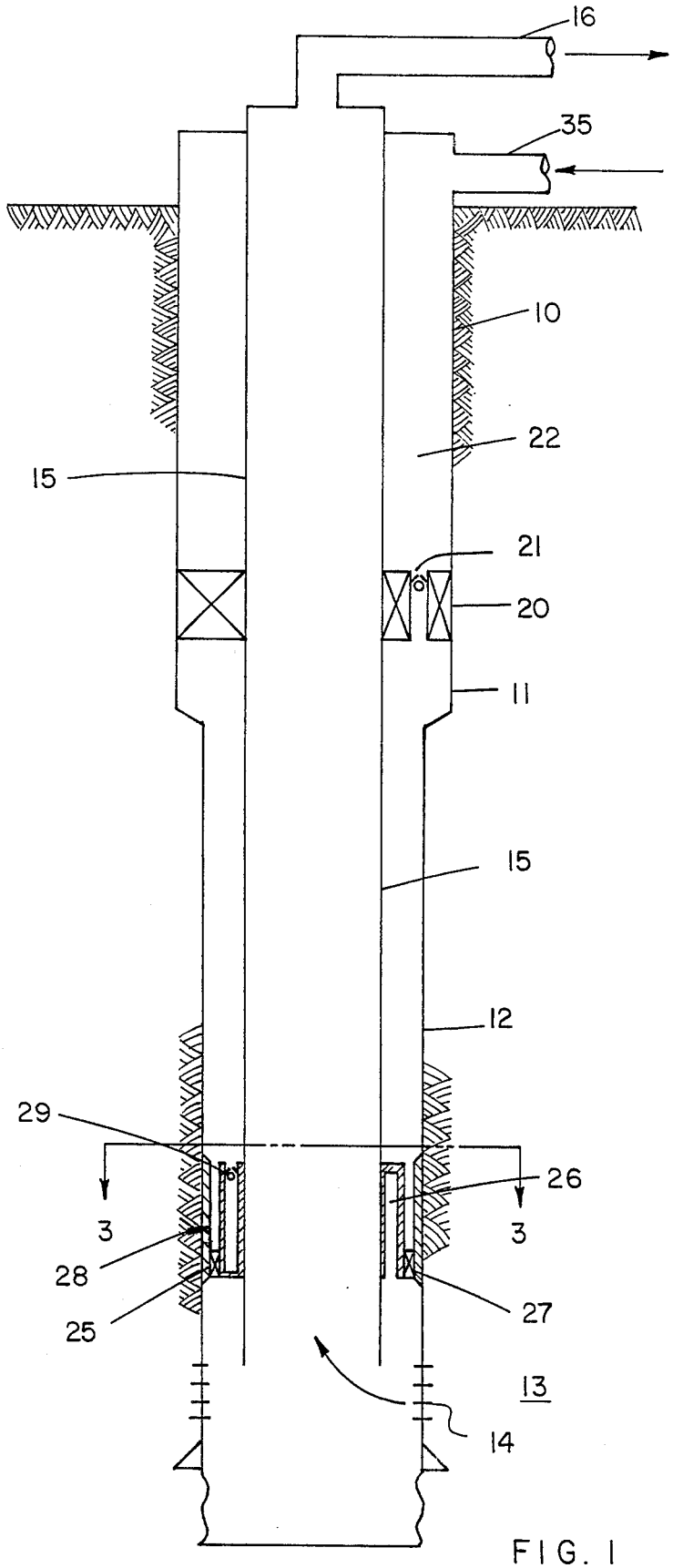
FIG. 1 is a schematic representation of the oil/gas well illustrating the invention.
Figure 2:
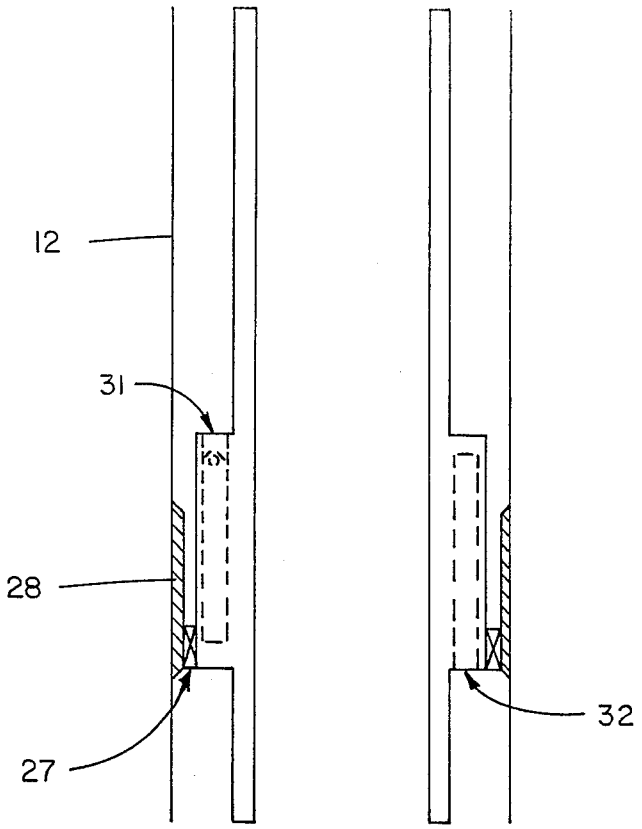
FIG. 2 is a schematic view of a portion of the well shown in FIG. 1.

Referring now the the drawings, in FIG. 1 there is shown a well bore in which is suspended a production well casing 10 having an upper portion 11 of greater diameter than a lower portion 12. Lower casing 12 penetrates a gas producing zone 13 which has been perforated by perforations, indicated at 14, in lower casing 12. Suspended within casing string 10 is a production tubing string 15, through which the production gases are produced through an outlet pipe 16 at the earth's surface. A packer/injection assembly 20 having a check valve 21 is positioned in the annulus 22 between upper casing string 11 and production tubing string 15.

Details of the specific well packer assembly 20 are not important to an understanding of the invention. The particular design may be any suitable structure capable of being run on tubing string 15 and set in upper casing 11, as indicated, and capable of sealing off the annulus 22 between upper casing 11 and production tubing 15 while permitting corrosion inhibitor solution to pass downwardly through the packer assembly but preventing fluid flow upwardly through the packer assembly. The present invention is designed for use with any packer structure capable of so operating. The assembly described in the aforementioned Ledet patent is an example of such structure.

Figure 3:
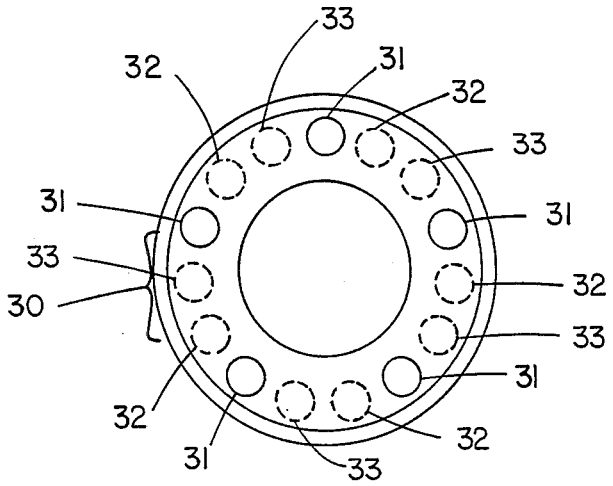
FIG. 3 is a cross-sectional view of the well bore taken on section line 3—3 of FIG. 1.

An annular gas trap 25 is formed by a special section of tubing 15 which is enlarged to accommodate a series of S-shaped conduits 26, each of which forms an individual gas trap indicated at 30 in FIG. 3. An annular seal 27 seals the enlarged tubing section against a polished bore receptacle 28 formed on lower casing string 12. Also, shown in FIG. 1 isa check valve 29 which permits fluids to pass downwardly through or into an individual gas trap but prevents flow of gas upwardly into the annulus above the annular gas trap. Valve 29 is an optional feature. Seal 27 may also be eliminated if the clearance between the enlarged tubing section and the polished bore of the casing is made sufficiently small as to act as a seal preventing upward gas migration.

For producing conditions the pressure differential across the polished bore receptacle seal will be small since the hydrostatic head of the corrosion inhibitor fluid plus the surface pump pressure will be almost the same as the bottom-hole flowing pressure. When the well is shut in, the check valve 21 in the injection valve/packer assembly 20 uphole will trap pressure on the inhibitor fluid in the lower annulus. As the shut-in bottom-hole pressure rises, the pressure on the inhibitor fluid will also increase. A very small amount of gas might enter the annulus in the process of compressing the inhibitor fluid, but after the pressure has equalized, the gas trap 25 will prevent any more gas from entering the annulus above the gas trap. The small amount of gas which does enter the annulus will be absorbed in the inhibitor fluid so it will not cause any problems.

The optional check valve 29 in the annular gas trap could prevent gas from entering the lower annulus above the gas trap in the event the injecton valve/-packer assembly check valve 21 failed, but the outside polished bore receptacle seal 27 would then have to be capable of withstanding high differential pressure. The broad design considerations for the annular gas trap, therefore, will be the use of a low pressure outside polished bore receptacle seal 27 and no check valves 29.

Figure 4:
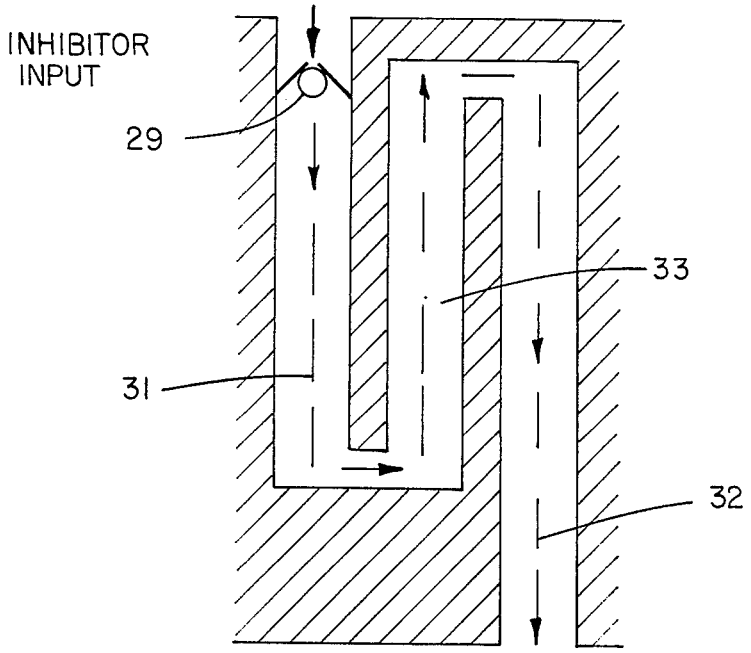
FIGS. 4 and 5 illustrate the annular gas trap in greater detail.
Figure 5:
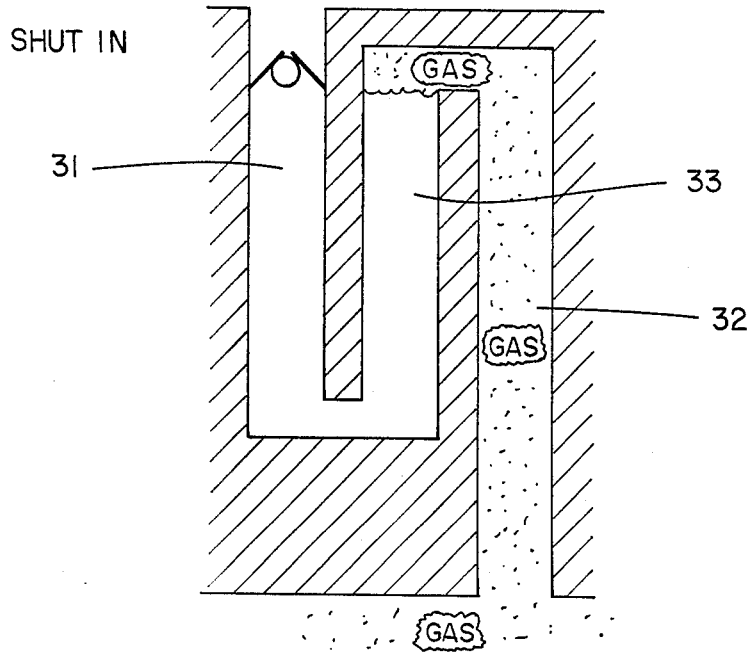

As shown in FIGS. 2–5, each individual gas trap, designated 30 in FIG. 3, consists of an inlet conduit or passageway 31 and an outlet passageway 32 and an intermediate conduit or passageway 33 connecting the lower end of passageway 31 and the upper end of passageway 32, as shown more clearly in FIG. 5.

As an example of sizing, tubing string 15 may be $2\frac{7}{8}$ inches in diameter with each of the passageways 31, 32 and 33 having a diameter of 178 inch.

In the operation of the present invention, the upper and lower well casing strings 11 and 12 are set and cemented in the well bore. Tubing string 15 is then run into well casing strings 11 and 12 with injection valve/-packer assembly 20 and annular gas trap 25 in their relative positions shown in FIG. 1. A perforator is then lowered on a wireline below the lower end of tubing string 15 and lower casing string 12 and formation 13 are perforated as indicated by perforations 14. Alternatively, formation 13 may be perforated before tubing string 15 is run. To combat corrosion, corrosion inhibitor is pumped down the annulus 22 from the surface through pipe inlet 35, through valve 21 and through injection/valve packer assembly 20. The input ports of passageways 31 of annular gas trap 25 permit the corrosion inhibitor in the annulus to enter the individual gas traps and flow through the S-shaped paths ie, down passageways 31, up passageways 33 and out the bottom ports of passageways 32. Five sets or series of S-shaped conduits 30 are shown in FIG. 3. As seen in FIG. 4 during normal operations the S-shaped conduits are filled with corrosion inhibitor which flows out the lower end of passageways 32 and then up tubing string 15 along with the production fluids and through outlet 16 at the earth's surface. When injection stops, corrosion inhibitor should fall from outlet passageways 32 permitting gas to enter as shown in FIG. 5. In the center passageways 33 however, the gas will be "trapped" above the corrosion inhibitor solution. By placing check valves 29 in conduits 31, potential backflow problems are eliminated.

The gas trap has few, and if the check valves are left out, no moving parts to maintain. It can be made very sturdy, requires only a low pressure outside seal 27 in a polished bore receptacle and permits the passage of the corrosion inhibitor while preventing the flip-flop of the corrosion inhibitor with the produced gas.

While preferred embodiments of the invention have been described and illustrated it is understood that changes and modifications may be made without departing from the spirit and scope of the invention as defined in the appended claims.

What is claimed is :

1. In well apparatus for use in inhibiting corrosion in wells in which an injection/packer assembly is positioned in the annulus between tubing and casing strings and corrosion inhibitor is injected down the annulus between said tubing and casing strings into the annulus below said injection/packer assembly, the improvement comprising an enlarged section of said tubing string providing at least one gas trap in the annulus between said tubing and casing strings below said injection/-packer assembly, said gas trap comprising a series of S-shaped conduits, each S-shaped conduit including a first passageway having an upper end open to said annulus above said gas trap, a second passageway having a lower end open to said annulus below said gas trap and a third passageway having a lower end open at the lower end of said first passageway and an upper end open to the upper end of said second passageway, each passageway extending substantially vertically; a polished bore receptacle formed on said casing string and including a seal on the outside surface of said enlarged section of tubing for engaging said polished bore receptacle to seal of said gas trap against said casing string; and a check value in each S-shaped conduit to prevent upward flow of fluid from said gas trap into said annulus above said gas trap.

2. In well apparatus for inhibiting corrosion in wells in which an injection/packer assembly is positioned in the annulus between smaller and large diameter well pipes and corrosion inhibitor is injected down the annulus between said well pipes into the annulus below said injection/packer assembly, the improvement comprising a gas trap arranged in the annulus between said well pipes below said injection/packer assembly said gas trap comprising at least one S-shaped conduit having three substantially vertical passageways, one of said passageways having an upper end open to said annulus above said gas trap, another of said passageways having a lower end open to said annulus below said gas trap and the third of said passageways having a lower end open only to the lower end of said one passageway and an upper end open only to the upper end of said other pasageway.

3. Well apparatus as recited in claim 2 in which said gas trap comprises a series of said S-shaped conduits surrounding said smaller diameter well pipe.

4. Well apparatus as recited in claim 3 in which a polished bore receptacle is formed on the inner surface of said larger diameter well pipe and including a seal on the outer surface of said gas trap for engaging said polished bore receptacle to seal off said gas trap against said larger diameter well pipe.

5. Well apparatus as recited in claim 4 including a check valve arranged in each S-shaped conduit to prevent upward flow of fluid from said gas trap and to said annulus above said gas trap.

6. Well apparatus as recited in claim 3 in which said smaller diameter well pipe is tubing and said larger diameter well pipe is casing.

7. Well apparatus as recited in claim 6 in which said gas trap is formed by a section of said tubing enlarged to accommodate said series of S-shaped conduits.

* * * * *